US011311758B2

(12) United States Patent
Vandemark et al.

(10) Patent No.: US 11,311,758 B2
(45) Date of Patent: Apr. 26, 2022

(54) DEVICE FOR EXTINGUISHING A FIRE

(71) Applicant: CellBlock FCS, LLC, Standish, ME (US)

(72) Inventors: Dylan Francis Vandemark, Hiram, ME (US); Matthew Lloyd Vandemark, Hiram, ME (US)

(73) Assignee: CELLBLOCK FCS, LLC, Standish, ME (US)

( * ) Notice: Subject to any disclaimer, the term of this patent is extended or adjusted under 35 U.S.C. 154(b) by 0 days.

(21) Appl. No.: 16/385,638

(22) Filed: Apr. 16, 2019

(65) Prior Publication Data

US 2019/0314658 A1 Oct. 17, 2019

Related U.S. Application Data

(60) Provisional application No. 62/658,729, filed on Apr. 17, 2018.

(51) Int. Cl.
*A62C 35/10* (2006.01)

(52) U.S. Cl.
CPC ..... *A62C 35/10* (2013.01)

(58) Field of Classification Search
CPC ..... A62C 35/10; A62C 35/08; A62C 19/00
USPC ..... 169/26
See application file for complete search history.

(56) References Cited

U.S. PATENT DOCUMENTS 2,917,116 A * 12/1959 Wyant ..... A62C 35/10 169/36
3,486,563 A * 12/1969 Cholin ..... A62C 8/06 169/26
3,782,475 A * 1/1974 Schmidt ..... A62C 8/06 169/50
6,012,532 A 1/2000 Kiefer et al.
6,572,948 B1 6/2003 Dykhoff
6,948,567 B1 9/2005 Cyphers et al.
8,439,123 B2 5/2013 Bennett
8,875,802 B2 * 11/2014 Jesclard, Jr. ..... A62C 8/06 169/48
9,180,324 B2 11/2015 Burkett
9,643,036 B2 5/2017 Burkett
9,890,988 B2 2/2018 Howland et al.
2007/0068686 A1 * 3/2007 Bennett ..... A62C 3/07 169/62

(Continued)

FOREIGN PATENT DOCUMENTS

DE 102010048051 4/2012

*Primary Examiner* — Steven M Cernoch

(74) *Attorney, Agent, or Firm* — Shlesinger, Arkwright & Garvey LLP

(57) ABSTRACT

The invention is a device for extinguishing a fire, the device comprises a pad adapted to be configured in various shapes and sizes and having a body or core filled with free-flowing expanded glass granulate having fire extinguishing properties, the body or core is compartmentalized to separately contain the free flowing granulate within defined regions, the body or core is formed from a sacrificial material that disintegrates upon exposure to heat whereby the free-flowing expanded glass granulate contained in the body or core is released onto the fire or source of heat to extinguish it. In one embodiment the device includes a fire resistant cover member. In another embodiment one side or face of the device is provided with a fire resistant layer or barrier so that only the opposite side or face of the device will disintegrate.

13 Claims, 4 Drawing Sheets

(56) References Cited

U.S. PATENT DOCUMENTS

| | | | |
|---|---|---|---|
| 2014/0069664 | A1 | 3/2014 | Chaujam |
| 2017/0110757 | A1 | 4/2017 | Pasewald |
| 2017/0155103 | A1 | 6/2017 | Pasewald |
| 2018/0087272 | A1 | 3/2018 | Vandemark et al. |

* cited by examiner

DEVICE FOR EXTINGUISHING A FIRE

CROSS-REFERENCE TO RELATED APPLICATIONS

This application claims the benefit of priority from U.S. Provisional Application Ser. No. 62/658,729, filed on Apr. 17, 2018, which is incorporated herein by reference.

FIELD OF THE INVENTION

The present invention relates to a device that may be placed on or adjacent a fire to extinguish it, particularly a fire associated with rechargeable cells, or batteries or various chemistries, including but not limited to consumer electronics and automotive batteries.

BACKGROUND OF THE INVENTION

When improperly handled, manufactured or overcharged, lithium-ion batteries are subject to thermal runaway i.e. the battery spontaneously increases in temperature and begins to vent hot and toxic pressurized gases. This causes the lithium ion fluid inside of the battery to ignite which can reach temperatures in excess of 2,000 degrees Fahrenheit. While it is possible to extinguish the flames by applying large amounts of water, the lithium inside the battery may react with the electrolytes and the water to generate hydrogen which can accelerate the fire. Sand or other granular minerals may be applied to a lithium battery fire; however, these minerals are only fire resistant and do not possess fire extinguishing properties. Accordingly, the application of these minerals to a lithium battery fire have been found to be unreliable, ineffective or impractical.

A fire occurring on an aircraft can be catastrophic for obvious reasons. The smoke and toxic vapors can create panic within the passenger cabin. It is imperative to quickly extinguish such fires. Current FAA guidelines recommend the use of water to extinguish a lithium battery fire. However, a sufficient quantity of water is not easily obtained on an aircraft during a flight nor can it be quickly and effectively applied to a fire. Although conventional fire extinguishers are available on an aircraft, they are limited in their effectiveness when applied to lithium battery fires.

Lithium battery fires are also problematic in the electronic industry, especially where large numbers of Li batteries, cells and personal electronic devices are collected, stored, recycled or repaired. It is known to dump scoops of sand or similar minerals onto a lithium battery fire in a laboratory setting, however the low porosity of the sand renders it an ineffective insulator of heat and it is useless to contain smoke and vapor. Furthermore, dumping or throwing sand onto a fire tends be haphazard and inefficient in practice and requires large quantities of sand be applied to the fire UN rated boxes and packages for the purpose of shipping, both domestically and internationally, lithium batteries or cells of various states of damage, charge or chemistry, require the packaging to be absorbent and provide a non-combustible filler or cushioning material. Historically, the absorbent and non-combustible material used is vermiculite. However, the use of vermiculite is disadvantageous due to complexity of the material itself including the dust associated with loose fill vermiculite. Further, this material lacks fire suppression and extinguishing properties.

A need has therefore existed for a device that will quickly and easily enable any user, without training, to effectively extinguish a fire, especially a fire caused by a lithium battery.

A need has also existed for inserts or liners for use within containers for shipping lithium batteries or cells in various states of damage, charge or chemistry that have superior cushioning and fire suppression/extinguishing characteristics.

BRIEF SUMMARY OF THE INVENTION

The invention is a device for extinguishing a fire, the device comprises a pad adapted to be configured in various shapes and sizes and having a body or core filled with free-flowing expanded glass granulate having fire extinguishing properties, the body or core is compartmentalized to separately contain the free flowing granulate within defined regions, the body or core is formed from a sacrificial material that disintegrates upon exposure to heat whereby the free-flowing expanded glass granulate contained in the body or core is released onto the fire or source of heat to extinguish it. In one embodiment, the device includes a fire resistant cover member. In another embodiment one side or face of the device is provided with a fire resistant layer or barrier so that only an opposite side or face of the device is exposed to a fire during use.

A device for extinguishing a fire, the device comprises a body, the interior of the body is filled with free-flowing expanded glass granulate having fire extinguishing properties, the interior of the body having at least two compartments to separately contain the free flowing granulate within defined regions of the body, the body is formed from a material adapted to disintegrate when exposed to heat whereby when the device is placed on a fire the free-flowing expanded glass granulate contained in the compartments is caused to be released.

DETAILED DESCRIPTION OF THE INVENTION

FIGS. 1 through 4 illustrate one embodiment of a device D for containing and extinguishing a fire according to the present invention. The device optionally includes a protective cover 2 affixed to a body or core member 4 that is filled with free-flowing expanded glass granulates 6 having fire extinguishing properties.

Figure 2:
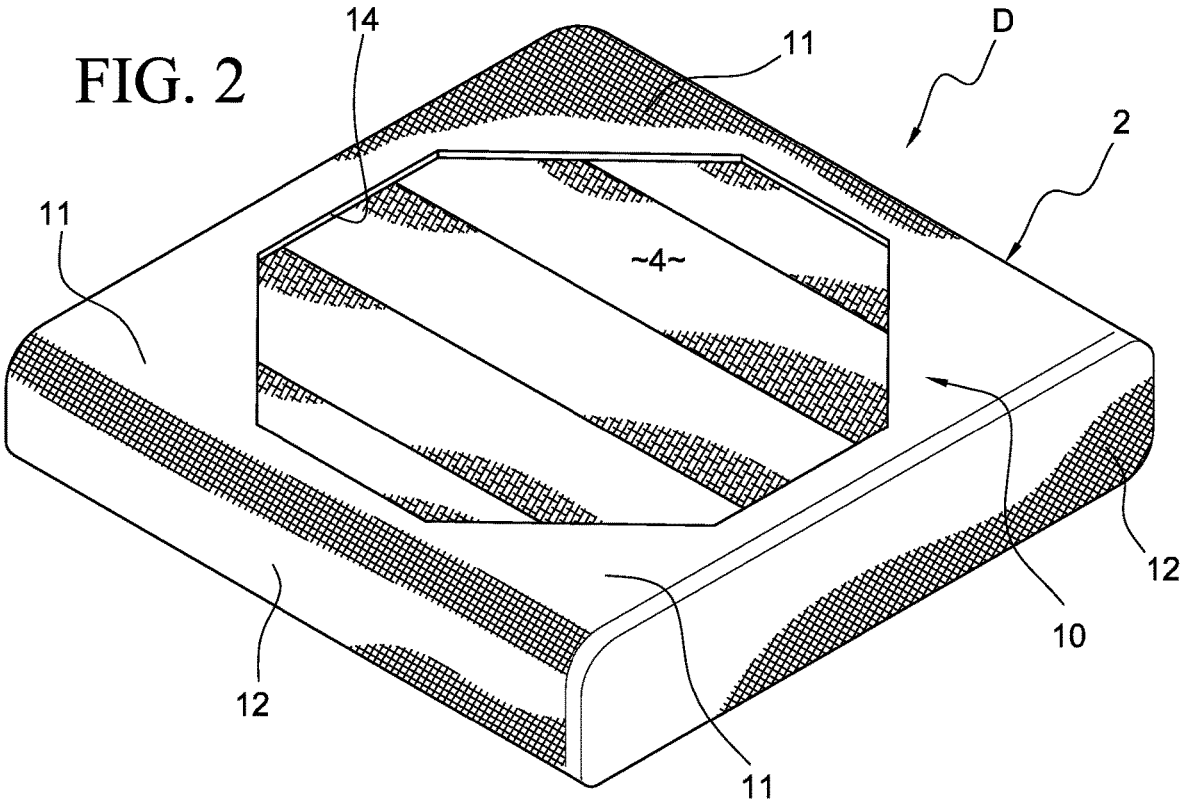
FIG. 2 is perspective view showing the opposite side of the device in FIG. 1.

The protective cover 2 has a top 8, bottom 10 and sides 12. As best shown in FIG. 2, the bottom 10 of the cover 2 is provided with an opening 14 that exposes the underlying body or core 4. The opening has a size sufficient to allow the body or core to come into direct contact with a fire to be extinguished and to retain the body or core within the cover prior to use. The opening 14 in FIG. 2 is shown to have a hexagonal shape, but other shapes and sizes are within the scope of the invention so long as it allows a sufficiently large surface area of the body or core to be directly exposed to a fire during use. The hexagonal shape will provide corner regions 11 on the bottom of the cover that retain the body or core within the cover 2. In a preferred embodiment the protective cover 2 is manufactured from a fire-resistant fabric or material that is sewn together using KEVLAR thread. One such fire-resistant material is manufactured by DuPont and sold under their NOMEX trademark. Other materials having similar characteristics are within the scope of the present invention. For example, the fire resistant material may be KEVLAR, ARAMID, a carbon fiber material or a silicate fiber material.

The body or core member 4 that contains the loose-fill granulate is constructed from a heat sensitive material that is combustible and will disintegrate when exposed to a flame or high heat. In a preferred embodiment the body or core member is constructed from a 100% polyester fabric coated with a PVC resin to increase its sensitivity to heat and flame. Other flammable fabrics and materials (e.g. cotton) are within the scope of the invention.

Figure 1:
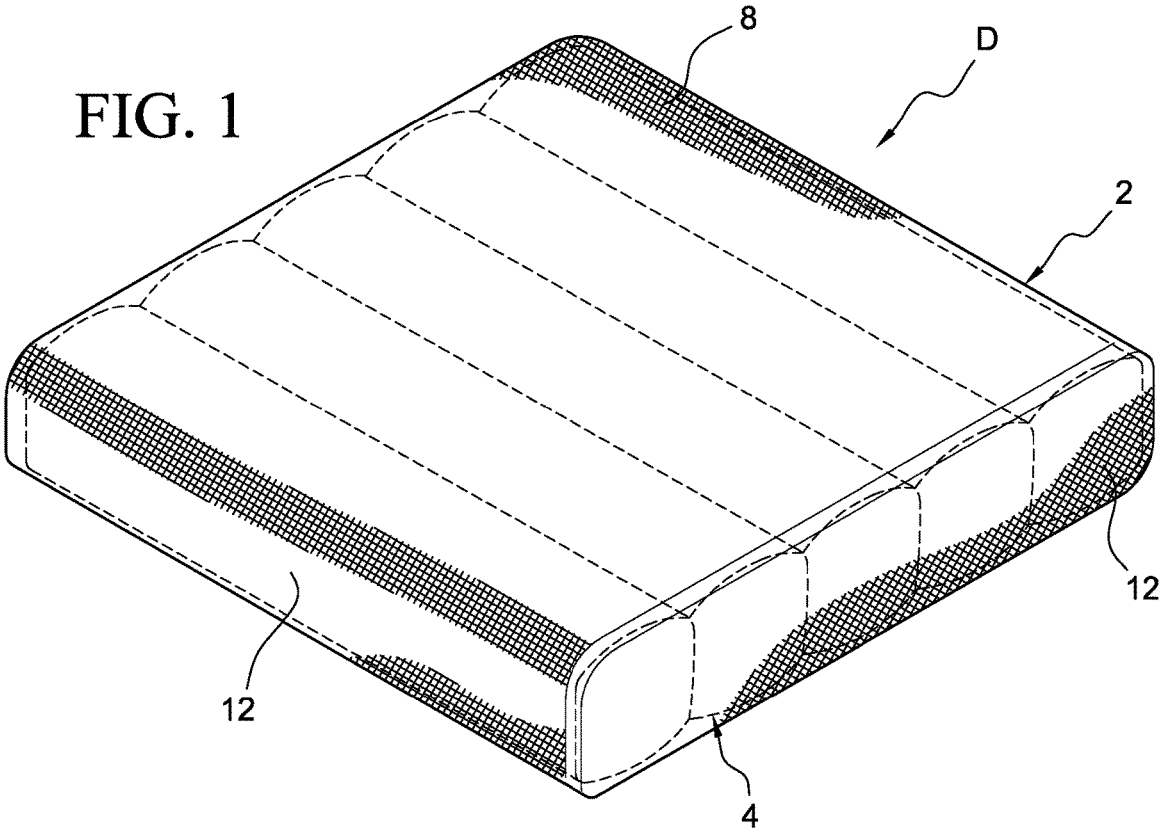
FIG. 1 is a perspective view showing one embodiment of the device according to the present invention that includes a removable protective cover and showing the underlying body or core member in hidden lines.
Figure 3:
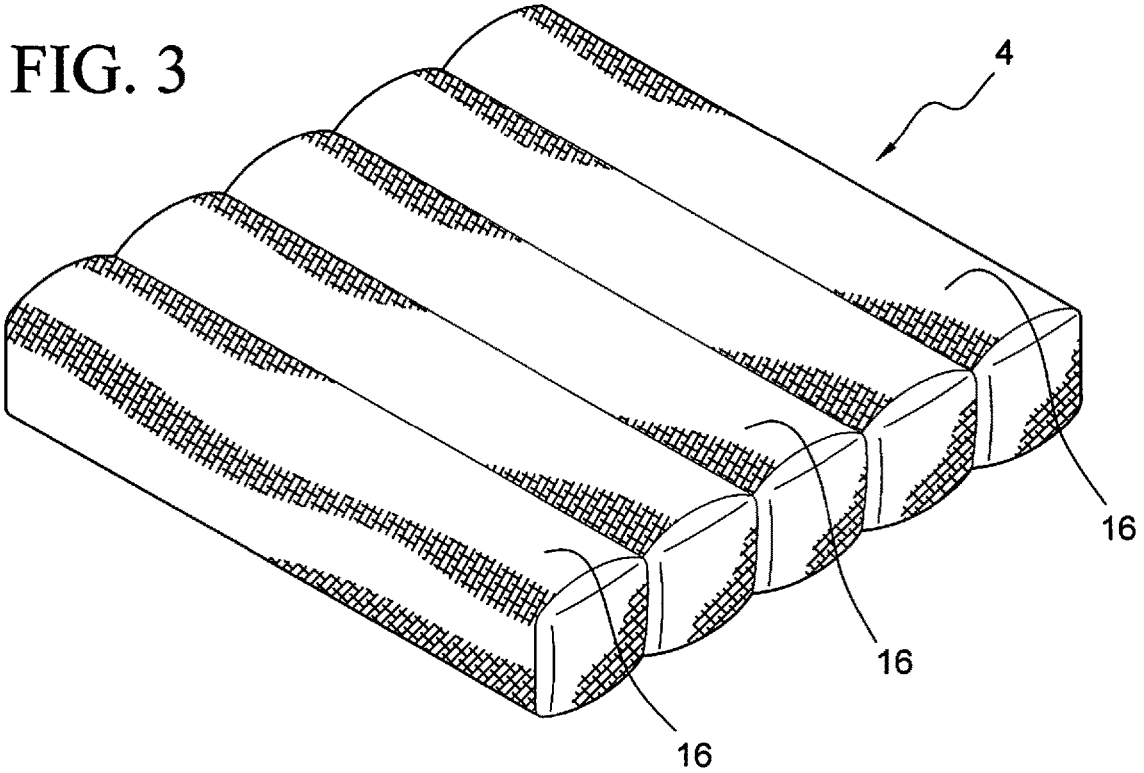
FIG. 3 is a perspective view showing the device according to the present invention without the cover.
Figure 4:
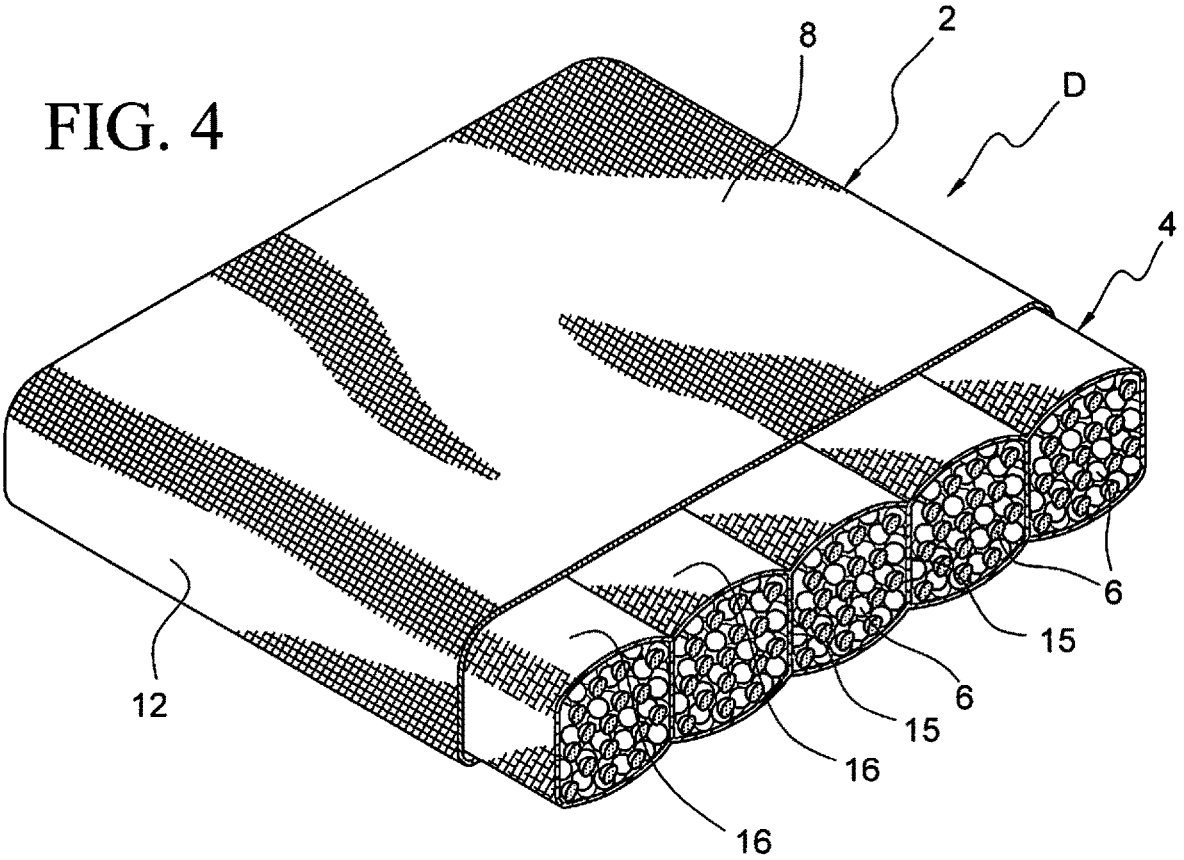
FIG. 4 is a perspective view of the device shown in FIG. 1 with a portion of the removable cover broken away and the underlying body or core shown in cross-section to expose the free-flowing expanded glass granulate contained within the compartments of the body or core.
Figure 5:
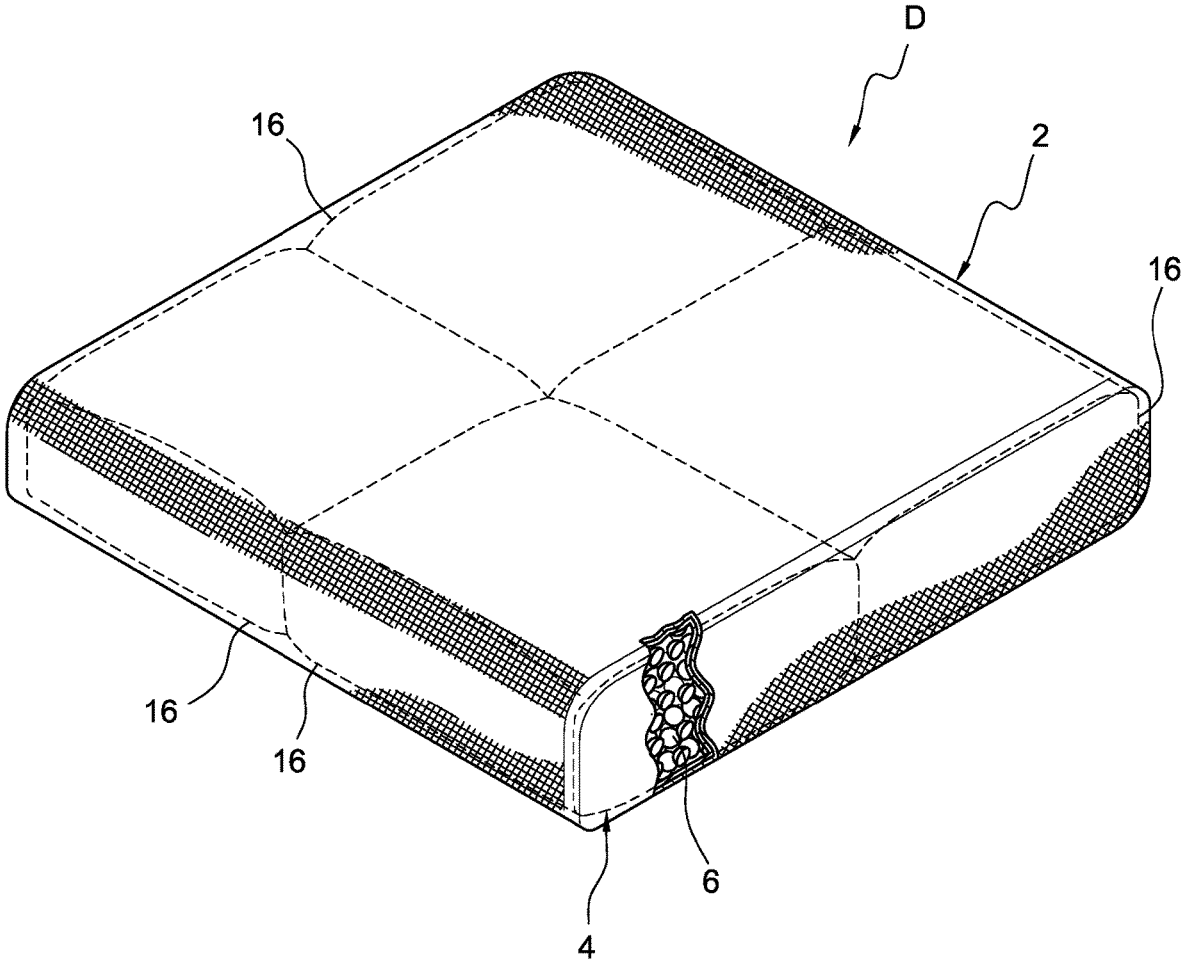
FIG. 5 is a perspective view of an alternative embodiment of the device shown in FIG. 1.

As best shown in FIGS. 1, 3 and 4, the body or core member 4 includes a series of interior baffles or compartments 16 separated by side walls 15, that are shown in these figures to be generally tubular in shape and aligned in a parallel relation to each other from one end of the body or core to the opposite end. It is within the scope of the invention to provide other shapes and arrangements for compartments 16 so long as the free flowing granulate contained in the compartments is prevented from shifting or excessively accumulating in any single region of the body or core and is maintained in a relatively uniformly distributed manner throughout the core. For example, the tubular compartments shown in FIGS. 1-4 may be square-shaped as best shown in FIG. 5. In addition, the body may be rectangular or circular instead of square shaped as shown in the drawings. The invention is adapted to be configured into any shape or size or thickness depending upon the end use of the device, for example, for use within a container or packaging having a particular size or shape.

While it is preferred that the body have at least two compartments to separate and uniformly distribute the free flowing granulate, the invention can function without compartments. As noted earlier, the body or core may be variable in size depending upon its end use. A typical size for use on an aircraft for purposes of suppressing and extinguishing a battery fire in a personal electronic device will be approximately twenty four inches square with a thickness of about two inches.

The compartments 16 of the body or core 4 are filled with free flowing expanded glass granules. The granules are relatively small, lightweight spheres of expanded (i.e. foamed) silicon dioxide glass having interior pores that provide a closed cell structure. The granules readily absorb any heat and smoke and actively extinguish a fire by displacing oxygen and melting onto the ignited battery or device. The size of the aggregate correlates to the interior pore size and hence its relatively low density that enhances its utility as a reactive extinguisher. A commercially available expanded glass granulate suitable for use in the present invention is sold by Dennert Poraver GmbH under the EXTOVER trademark, which is incorporated herein by reference. The amount of expanded glass granulate provided in each compartment is an amount sufficient to substantially fill the compartment. As is apparent, it is within the scope of the invention to provide a lesser amount of granulate.

The size of the expanded glass granulate in the present invention is preferably non-uniform and comprises a blend of different size granules. The smallest size granules have relatively greater density and a smaller pore size while the largest sized granules have the lower density and a larger pore size. In a preferred embodiment, the size of the loose fill granulate is between about 1 mm diameter to about 4 mm in diameter. A suitable composition for the granulate is a blend of 1 mm, 2 mm, 3 mm and 4 mm diameter size spheres combined in a 1:1:1:1 ratio. The preferred blend has a total air content of about 80% by volume and an average density of about 10 bs/ft^3 to promote sufficient absorption of the liquid electrolyte in an ignited battery, provide enhanced insulative properties from the heat of the fire and also provide low heat transference. The intense heat generated by the lithium battery fire causes at least some of the granules to melt which encases the battery as the fire is smothered and extinguished.

The use of compartments 16 within the body or core member 4 to individually retain the free-flowing granulate provides multiple functions. It to evenly distribute the granulate 6 throughout the body or core 4 and maintains its shape and structure and prevent excessive accumulation of the free flowing granulate within any single area of the body or core. Without the compartments the body or core can be too flexible and amorphous and not maintain a desired thickness and thus, in some instance, not release the granules on a fire in a controlled and evenly distributed manner. Compartments that are not sufficiently heated to release the granules during a fire event remain unopened and serve to provide ballast to keep the device on the fire and ensure the perimeter of the fire is surrounded by protective granulates in the event the fire reignites.

As noted earlier, a fire resistant protective cover 2 may optionally be provided in combination with the body or core member 4. The cover provides a barrier or protection from heat and flames when the device is placed on a fire and it also ensures the bottom face 10 of the body or core is directly exposed to the fire. The cover may also function to assist in retaining loose fill granulate that has been released from the body or core onto a fire. Due to its fire-resistance characteristics, the protective cover is reusable following a fire event. A new body or core may be placed within the cover so that it is ready for reuse.

FIG. 5 shows an alternative embodiment of the device D where the body or core member 4 filled with free-flowing expanded glass granulates 6 has four square-shaped baffles or compartments 16, each of which separately contain the expanded glass granulate and separately release the granulate 6 when the compartment is exposed to high heat or a flame.

In the event of a fire on an aircraft of within a laboratory including a fire generated by a lithium battery or electronic device powered by a lithium battery, the device D is simply placed over the ignited battery or electronic device to suppress the fire and extinguish it. If the device D includes the fire resistant cover, the bottom side 10 of the cover 12 is placed on the fire so that the body or core member 4 will be directly exposed to the fire. The sacrificial nature of the body or core 4 enable it to disintegrate from the heat of the fire and thereby release the expanded glass granulate directly on the fire in an unrestricted manner. The expanded glass granulate absorbs gas and smoke generated by the fire including any electrolyte and eventually extinguish the fire.

Figure 6:
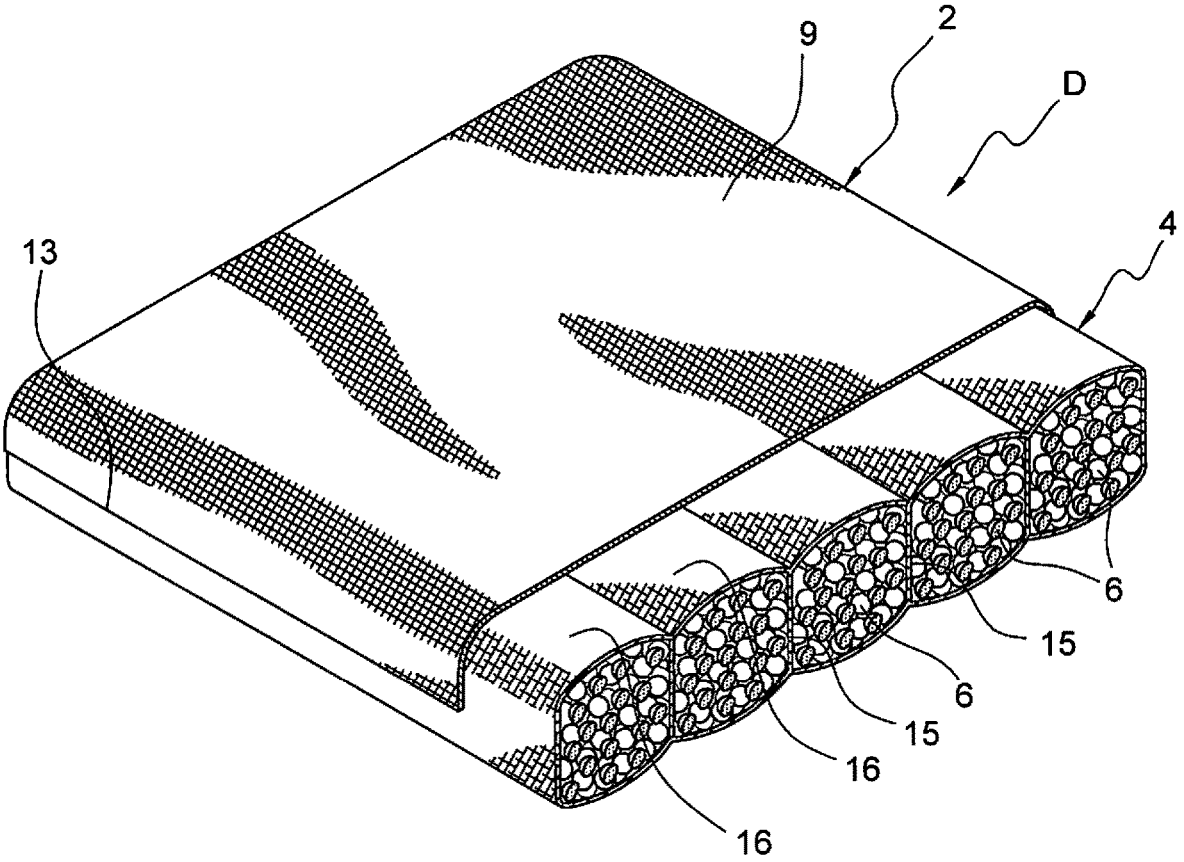
FIG. 6 is a perspective view of an alternative embodiment adapted for use within a shipping container for flammable or hazardous materials such as lithium batteries.

FIG. 6 shows an alternative embodiment of the device D for use in connection with a container for shipping lithium batteries or electronic goods and where the body or sacrificial core member 4 contains a series of baffles or compartments 16 filled with free-flowing expanded glass granulates 6. A fire resistant protective layer 2 is attached, by sewing or otherwise, along perimeter edge 13 to a first face 9 of the device so that a second opposite face is uncovered. One such fire-resistant material is manufactured by DuPont and sold under their NOMEX trademark. Other materials having similar fire resistant characteristics are within the scope of the present invention. For example, the fire resistant material may be KEVLAR, ARAMID, a carbon fiber material or a silicate fiber material. It is within the scope of the invention to secure the protective layer to the underside of first face 9 rather than on top as shown in the figure. The device for this embodiment may be placed within a box or shipping carton so that the exposed or uncovered face surrounds or otherwise encloses the lithium battery being shipped while fire resistant face 9 will provide a heat resistant barrier in the event a fire occurs within the shipping container.

While this invention has been described as having a preferred design, it is understood that it is capable of further modifications, uses and adaptations, both in whole and in part, while following the general principle of the invention and including such departures from the present disclosure as is known or customary practice in the art to which this invention pertains, and as may be applied to the central features of this invention.

We claim:

1. A device for extinguishing a fire, the device comprises a body having a first face and a second face opposite the first face and side walls that extend from the first and second faces, the body is filled with a free-flowing expanded glass granulate having fire extinguishing properties, an interior of the body having at least two compartments to separately contain the free flowing granulate within defined regions thereof, each of the at least two|compartments having four sides, the first and second sides are formed by the first and second faces respectively and the third and fourth sides extend transverse to the first and second sides, the fourth side of one of the at least two compartments is parallel to the third side of the other of the at least two compartments, a removable fire resistant cover member, the cover member having a top surface, a bottom surface and side surfaces, the bottom surface having an opening with corner regions adjacent the opening, the cover member covers one of the first and second faces and the side walls of the body and the corner regions cover the other of the first and second faces to retain the body within the cover member, the body is formed from a material that is adapted to disintegrate upon exposure to heat so that when the other of the first and second faces is exposed to a fire, the free-flowing expanded glass granulate is released onto the fire from the defined regions of the body, and the released expanded glass granulate is covered by the surrounding cover member.

2. The device as in claim 1 and wherein the at least two compartments are tubular shaped and extend from the first end to the second end.

3. The device as in claim 1 and further comprising additional compartments.

4. The device as in claim 1 and wherein the body is formed from a flammable material.

5. The device as in claim 1 and wherein the free-flowing expanded glass granulate are foamed silicon dioxide glass spheres.

6. The device as in claim 5 and wherein the foamed silicon dioxide glass spheres have a diameter between about 1 mm to about 4 mm.

7. The device as in claim 6 and wherein the foamed silicon dioxide glass spheres are provided as a blend of spheres having a diameter of 1 mm, 2 mm, 3 mm and 4 mm and in a ratio of 1:1:1:1.

8. The device as in claim 1 and wherein the at least two compartments are uniform in size and shape.

9. The device as in claim 1 and wherein the at least two compartments are secured to each other along a longitudinal axis thereof.

10. The device as in claim 1 and wherein the at least two compartments are square shaped.

11. The device as in claim 1 and wherein the at least two compartments are separated from each other by at least one of the third and fourth sides.

12. The device as in claim 1 and wherein the cover member is a flexible fabric material.

13. The device as in claim 1 and wherein the opening has a generally hexagonal shape.

* * * * *